US006847338B2

(12) United States Patent
Abe et al.

(10) Patent No.: US 6,847,338 B2
(45) Date of Patent: Jan. 25, 2005

(54) ELECTRON SOURCE APPARATUS AND IMAGE FORMING APPARATUS

(75) Inventors: Naoto Abe, Kanagawa (JP); Hideaki Mitsutake, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 09/726,020

(22) Filed: Nov. 30, 2000

(65) Prior Publication Data

US 2001/0024085 A1 Sep. 27, 2001

Related U.S. Application Data

(63) Continuation of application No. PCT/JP00/02171, filed on Apr. 4, 2000.

(30) Foreign Application Priority Data

Apr. 5, 1999 (JP) ..... 11-097852

(51) Int. Cl.[7] ..... G09G 3/28

(52) U.S. Cl. ..... 345/60; 315/169.2

(58) Field of Search ..... 315/169.1–169.4; 313/422, 495; 345/60, 65, 67, 74.1, 74, 55, 84, 87, 82, 76; 349/143, 23

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,300,862 A | | 4/1994 | Parker et al. | 312/169.1 |
| 5,569,974 A | | 10/1996 | Morikawa et al. | 313/310 |
| 5,682,085 A | | 10/1997 | Suzuki et al. | 315/169.1 |
| 5,760,538 A | * | 6/1998 | Mitsutake et al. | 313/422 |
| 6,256,002 B1 | * | 7/2001 | Shinoda | 345/60 |
| 6,339,414 B1 | * | 1/2002 | Todokoro et al. | 345/74.1 |
| 6,384,804 B1 | * | 5/2002 | Dodabalapur et al. | 345/82 |
| 6,426,782 B1 | * | 7/2002 | Nakajima | 349/23 |

FOREIGN PATENT DOCUMENTS

| | | |
|---|---|---|
| EP | 0 688 035 A1 | 12/1995 |
| EP | 0762371 A2 | 3/1997 |
| EP | 0762372 A2 | 3/1997 |

(List continued on next page.)

OTHER PUBLICATIONS

M.I. Elinson, Radio Engineering Electron Physics, 10, 1290 (1965); The Emission of Hot Electrons and the Field Emission of Electrons from Tin Oxide.

G. Dittmer, Thin Solid Films, 9, 317 (1972); Electrical Conduction and Electron Emission of Discontinuous Thin Films.

M. Hartwell, IEEE Transactions Electron Devices Conference, 519 (1975); Strong Electron Emission from Patterned Thin–Indium Oxide Thin Films.

(List continued on next page.)

*Primary Examiner*—Wilson Lee

(74) *Attorney, Agent, or Firm*—Fitzpatrick, Cella, Harper & Scinto

(57) ABSTRACT

There are provided an electron source apparatus capable of suppressing variations in electron emission state from electron-emitting devices even with an arrangement using spacers (9), and an image forming apparatus using the electron source apparatus. A plurality of row-direction wiring lines (8) and a plurality of column-direction wiring lines (6) are formed on a substrate (1) so as to cross each other. An electron-emitting device made up of device electrodes (2, 3), a conductive film (4), and an electron-emitting portion 5 is formed at each intersection between the row-direction wiring line (8) and the column-direction wiring line (6). The spacers (9) are arranged on some of the row-direction wiring lines (8). The column-direction wiring lines (6) are respectively connected to controlled constant current sources (221*a*, 221*b*, 221*c*) serving as current sources capable of outputting desired current values. The respective row-direction wiring lines (8) are connected to a voltage application means constituted by a voltage source (223) and a switching circuit (222) for selecting the row-direction wiring lines (8) while sequentially scanning them.

13 Claims, 14 Drawing Sheets

FOREIGN PATENT DOCUMENTS

| | | |
|---|---|---|
| EP | 0798691 A1 | 10/1997 |
| EP | 0 869 531 | 10/1998 |
| JP | 61-31332 | 2/1989 |
| JP | 2-257551 | 10/1990 |
| JP | 3-55738 | 3/1991 |
| JP | 4-28137 | 1/1992 |

OTHER PUBLICATIONS

H. Araki, Journal of the Vacuum Society of Japan, vol. 26, No. 1, p. 22 (1983); Electroforming and Electron Emission of Carbon Thin Films.

W.P. Dyke, Advances in Electronics and Electron Physics, 8, 89 (1956); Field Emission.

C. A. Spindt, Journal of Applied Physics, 47, 5248 (1976); Physical properties of thin–film field emission cathodes with molybdenum cones.

C.A. Mead, Journal of Applied Physics, 32, 646 (1961); Operation of Tunnel–Emission Devices.

R. Meyer, Technical Digest of 4th International Vacuum Microelectronics Conference, Recent Development on Microtips Display at Leti, Nagahama, pp. 6–9 (1991).

* cited by examiner

ELECTRON SOURCE APPARATUS AND IMAGE FORMING APPARATUS

This application is a continuation of International Application No. PCT/JP00/02171, filed Apr. 4, 2000, published in Japanese under PCT Article 21(2) as publication no. WO00/60568 on Oct. 12, 2000, which claims the benefit of Japanese Patent Application No. 11-097852, filed Apr. 5, 1999.

TECHNICAL FIELD

The present invention relates to an electron source apparatus having a plurality of electron-emitting devices wired in a matrix, and an image forming apparatus using the electron source apparatus.

BACKGROUND ART

Conventionally, two types of devices, namely thermionic and cold cathode devices, are known as electron-emitting devices. Known examples of the cold cathode devices are field emission type electron-emitting devices (to be referred to as FE type electron-emitting devices hereinafter), and metal/insulator/metal type electron-emitting devices (to be referred to as MIM type electron-emitting devices hereinafter). A known example of surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted by a small-area thin film formed on a substrate by flowing a current in parallel with the film surface. The surface-conduction emission type electron-emitting device includes electron-emitting devices using an Au thin film [G. Dittmer, "Thin Solid Films", 9,317 (1972)], an $In_2O_3/SnO_2$ thin film[M. Hartwell and C. G. Fonstad, "IEEE Trans. ED Conf.", 519 (1975)], a carbon thin film[ Hisashi Araki et al., "Vacuum", Vol. 26, No. 1, p. 22 (1983)], and the like, in addition to an $SnO_2$ thin film according to Elinson mentioned above.

Known examples of the FE type electron-emitting devices are described in W. P. Dyke and W. W. Dolan, "Field emission", Advance in Electron Physics, 8, 89 (1956) and C. A. Spindt, "Physical properties of thin-film field remission cathodes with molybdenium cones", J. Appl. Phys., 47, 5248 (1976).

As another FE type device structure, there is an example in which an emitter and gate electrode are arranged on a substrate to be almost parallel to the surface of the substrate.

A known example of the MIM type electron-emitting devices is described in C. A. Mead, "Operation of tunnel emission Devices", J. Appl. Phys., 32,646 (1961).

Since the above-described cold cathode devices can emit electrons at a temperature lower than that for thermionic cathode devices, they do not require any heater. The cold cathode device has a structure simpler than that of the thermionic cathode device and can shrink in feature size. Even if a large number of devices are arranged on a substrate at a high density, problems such as heat fusion of the substrate hardly arise. In addition, the response speed of the cold cathode device is high, while the response speed of the thermionic cathode device is low because thermionic cathode device operates upon heating by a heater.

For this reason, applications of the cold cathode devices have enthusiastically been studied.

Of cold cathode devices, the surface-conduction emission type electron-emitting devices have a simple structure and can be easily manufactured, so that many devices can be formed on a wide area. As disclosed in Japanese Patent Laid-Open No. 64-31332 filed by the present applicant, a method of arranging and driving many devices has been studied.

Regarding applications of the surface-conduction emission type electron-emitting devices, e.g., image forming apparatuses such as an image display apparatus and image recording apparatus, charge beam sources, and the like have been studied.

Particularly as an application to image display apparatuses, as disclosed in the U.S. Pat. No. 5,066,883 and Japanese Patent Laid-Open Nos. 2-257551 and 4-28137 filed by the present applicant, an image display apparatus using a combination of a surface-conduction emission type electron-emitting device and a fluorescent substance which emits light upon irradiation with an electron beam has been studied. This type of image display apparatus using a combination of the surface-conduction emission type electron-emitting device and fluorescent substance is expected to exhibit more excellent characteristics than other conventional image display apparatuses. For example, compared to recent popular liquid crystal display apparatuses, the above display apparatus is superior in that it does not require any backlight because of self-emission type and that it has a wide view angle.

A method of driving a plurality of FE type electron-emitting devices arranged side by side is disclosed in, e.g., U.S. Pat. No. 4,904,895 filed by the present applicant. A known application of FE type electron-emitting devices to an image display apparatus is a flat panel display apparatus reported by R. Meyer et al. [R. Meyer: "Recent Development on Microtips Display at LETI", Tech. Digest of 4th Int. Vacuum Microelectronics Conf., Nagahara, pp. 6–9 (1991)]. An application of many MIM type electron-emitting devices arranged side by side to an image display apparatus is disclosed in Japanese Patent Laid-Open No. 3-55738 filed by the present applicant.

FIG. 1 shows an example of a multi electron source wiring method. In the electron source shown in FIG. 1, m cold cathode devices in the vertical direction and n cold cathode devices in the horizontal direction, i.e., a total of n×m cold cathode devices are two-dimensionally arrayed in a matrix. In FIG. 1, reference numeral 3074 denotes a cold cathode device; 3072, a row-direction wiring line; 3073, a column-direction wiring line; 3075, a wiring resistance of the row-direction wiring line; and 3076, a wiring resistance of the column-direction wiring line. Reference symbols Dx1, Dx2, . . . , Dxm denote feeding terminals of the row-direction wiring lines; and Dy1, Dy2, . . . , Dyn, feeding terminals of the column-direction wiring lines. This simple wiring method is called a matrix wiring method. The matrix wiring method can easily manufacture a multi electron source because of a simple structure.

When a multi electron beam by the matrix wiring method is to be applied to an image forming apparatus, m and n must be several hundreds or more in order to ensure the display capacitance. Further, a cold cathode device must accurately output an electron beam with a desired intensity in order to display an image at an accurate luminance.

When many cold cathode devices wired in a matrix are to be driven, devices of one row of the matrix are simultaneously driven. The row to be driven is sequentially switched to scan all the rows. According to this method, the driving time assigned each device is ensured n times longer than in a method of sequentially scanning all the devices one by one. Thus, the luminance of the display apparatus can be increased.

More specifically, there are proposed an arrangement in which a voltage source is connected to matrix wiring to drive devices, and a method of driving FE type devices using a controlled constant current source, as disclosed in U.S. Pat. No. 5,300,862 to Parker et al. FIG. 2 is a circuit diagram for explaining this.

In U.S. Pat. No. 5,300,862, the X direction shown in FIG. 2 is a row direction, and the Y direction is a column direction. In the following description, however, the X direction is defined as a column direction, and the Y direction is defined as a row direction in order to match the description of the present invention.

In FIG. 2, reference numerals 2201*a*, 2201*b*, and 2201*c* denote controlled constant current sources; 2202, a switching circuit; 2203, a voltage source; 2204*a*, column wiring lines; 2204*b*, row wiring lines; and 2205, FE type devices.

The switching circuit 2202 selects one of the row wiring lines 2204*b*, and connects it to the voltage source 2203. The controlled constant current sources 2201*a*, 2201*b*, and 2201*c* supply currents to the respective column wiring lines 2204*a*. These operations are properly performed in synchronism with each other to drive FE type devices of one row.

Arrangements in which an electron source having surface-conduction emission type electron-emitting devices is driven using a constant current source are disclosed in European Patent Laid-Open EP688035A, EP762371A, EP762372A, and EP798691A.

DISCLOSURE OF INVENTION

In an electron source apparatus, few substances desirably exist in the space between an electron source and a counter substrate facing the electron source. However, if substances present in the space are reduced to be smaller in number than substances present in an atmosphere outside the apparatus, the compression pressure is generated to the electron source apparatus. To prevent this, there is known an arrangement in which spacers are interposed between the electron source and the counter substrate in the electron source apparatus. There is also known an arrangement in which spacers are arranged on the wiring lines of the electron source. The arrangement in which spacers are arranged on the wiring lines of the electron source is desirable as an arrangement using spacers. However, the inventor of the present application has found that arranging spacers on wiring lines varies the electron emission state from electron-emitting devices.

Further, the inventor of the present application has found that the variations become more typical when the following arrangements (1) to (4) are employed:

(1) In the electron source, a plurality of wiring lines are laid out in a matrix, and electron-emitting devices are formed at or near the intersections of the matrix.

(2) One of row-direction wiring lines of matrix wiring is selected, and signals are supplied from column-direction wiring lines to a plurality of electron-emitting devices connected to the selected row-direction wiring line to drive the devices.

(3) In arrangement (2), the electron-emitting device is an electron-emitting device in which when the device receives different potentials from two wiring lines (row-direction wiring line and column-direction wiring line), a current amount flowing between the two wiring lines (row-direction wiring line and column-direction wiring line) connected to the device is relatively larger than an emitted current amount.

(4) The spacer is conductive (conductivity of the spacer is high).

The inventor of the present application has made extensive studies to find out that the found phenomena occur when spacers are arranged on some of wiring lines among a plurality of wiring lines, or spacers are arranged at different positions on wiring lines, the resistance value of an electrical path extending from a driving circuit to an electron-emitting device is influenced by the presence of the spacer in driving the electron-emitting device via a wiring line.

The inventor of the present application has found the influence of the spacer on the electrical path extending from the driving circuit to the electron-emitting device, and has found as a result of extensive studies an arrangement capable of suitably driving the electron-emitting device even with an arrangement suffering this influence.

One invention of an electron source apparatus according to the present application has the following arrangement.

An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and spacer for maintaining an interval between the electron source and the counter substrate is arranged on some of the row-direction wiring lines among the plurality of row-direction wiring lines is characterized by comprising:

- a circuit for sequentially turning on the plurality of row-direction wiring lines; and
- a controlled current application circuit for applying a predetermined controlled current to the plurality of column-direction wiring lines.

Another invention of an electron source apparatus according to the present application has the following arrangement.

An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and spacers for maintaining an interval between the electron source and the counter substrate are arranged at different positions on the plurality of row-direction wiring lines is characterized by comprising:

- a circuit for sequentially turning on the plurality of row-direction wiring lines; and
- a controlled current application circuit for applying a predetermined controlled current to the plurality of column-direction wiring lines.

Still another invention of an electron source apparatus according to the present application has the following arrangement.

An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and spacer for maintaining an interval between the electron source and the counter substrate is electrically connected to some of the row-direction wiring lines among the plurality of row-direction wiring lines is characterized by comprising:

a circuit for sequentially turning on the plurality of row-direction wiring lines; and a controlled current application circuit for applying a predetermined controlled current to the plurality of column-direction wiring lines.

Still another invention of an electron source apparatus according to the present application has the following arrangement.

An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and spacers for maintaining an interval between the electron source and the counter substrate are electrically connected to the row-direction wiring lines at different positions on the plurality of row-direction wiring lines is characterized by comprising:

a circuit for sequentially turning on the plurality of row-direction wiring lines; and a controlled current application circuit for applying a predetermined controlled current to the plurality of column-direction wiring lines.

According to the electron source apparatus of each invention described above, the controlled current application circuit adjusted to apply a predetermined current can be used to suppress variations in current applied to electron-emitting devices and suppress variations in electron emission state from the electron-emitting devices even when the resistance value of an electrical path extending from a driving circuit to an electron-emitting device is influenced by the nonuniform arrangement of spacers, i.e., spacers exist on only some wiring lines, and/or the positions of spacers on wiring lines are different, or when the resistance value of the electrical path is influenced by nonuniform electrical connection between spacers and wiring lines, i.e., spacers are electrically connected to some wiring lines but are not electrically connected to some wiring lines, and/or positions electrically connected to spacers on wiring lines are different.

The ON state of the row-direction wiring line in each invention is a state in which a selected row-direction wiring line receives a potential different from a potential to an unselected row-direction wiring line, and an electron-emitting device connected to the selected row-direction wiring line can emit electrons in cooperation with control from a column-direction wiring line. This selection is sequentially performed to line-sequentially drive devices.

The circuit for turning on row-direction wiring lines and the controlled current application circuit in each invention can adopt various arrangements, and can be implemented as an integrated circuit.

In each invention, an arrangement in which the row-direction wiring lines are arranged on the column-direction wiring lines via insulating layers is preferable.

In each invention, a section of the spacer cut along a plane parallel to a plane in which the counter substrate spreads preferably has a longitudinal direction in a direction in which the row-direction wiring line extends.

In each invention, one of the spacers is preferably electrically connected to only one of the row-direction wiring lines. In particular, an arrangement in which the row-direction wiring lines are arranged on the column-direction wiring lines via insulating layers, and a spacer is arranged on one row-direction wiring line without the mediacy of any column-direction wiring line is preferable.

Each invention can be preferably adopted when the spacer comprises a spacer substrate and a portion formed from a material having a resistivity lower than the spacer substrate.

Since the spacer may be charged, at least part of the spacer must be made conductive in order to suppress charge-up. In this case, an arrangement in which a conductive film is formed on an insulating spacer substrate is preferable. This arrangement is especially preferable when the sheet resistance measured after the conductive film is formed is $10^7$ Ω/□ or more and $10^{14}$ Ω/□ or less. An arrangement in which an electrode is formed on part of the spacer in order to, e.g., make the potential of the spacer uniform can be preferably employed. Especially when the spacer is arranged along a wiring line, an arrangement in which the electrode is formed on a surface of the spacer facing the wiring line is preferably employed.

By forming the conductive film and electrode described above on the spacer, the influence on the wiring potential caused by electrical connection of the spacer to the wiring line increases. In this case, the invention of the present application can be preferably applied.

The present application includes an invention of an image forming apparatus comprising the electron source apparatus of each invention, and an image forming member for forming an image by irradiation of electrons from the electron source apparatus.

In the invention of the image forming apparatus, the counter substrate may also serve as the image forming member. To form an image, an arrangement using fluorescent substances which emit light upon irradiation of electrons is preferable. A counter substrate having the fluorescent substances is especially preferably used as the image forming member.

BRIEF DESCRIPTION OF DRAWINGS

FIG. 5 shows sectional views of the steps in forming the electron source apparatus shown in FIG. 1 and the like;

FIG. 6 shows plan views of the steps in forming the electron source apparatus shown in FIG. 1 and the like;

FIG. 7 shows plan views of the steps in forming the electron source apparatus shown in FIG. 1 and the like;

BEST MODE OF CARRYING OUT THE INVENTION

Figure 1:
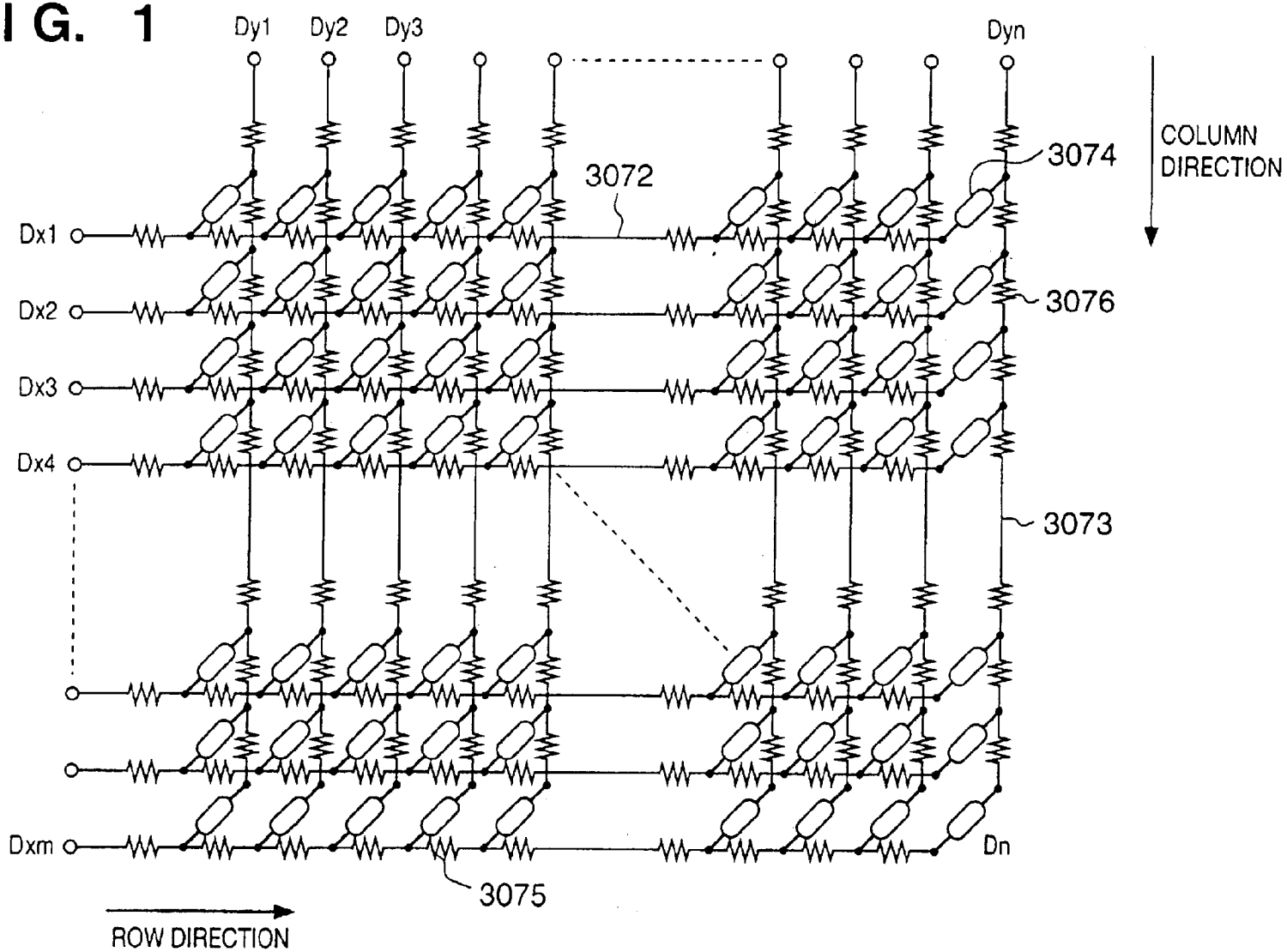
FIG. 1 is a circuit diagram showing matrix wiring in a conventional electron source apparatus.
Figure 2:
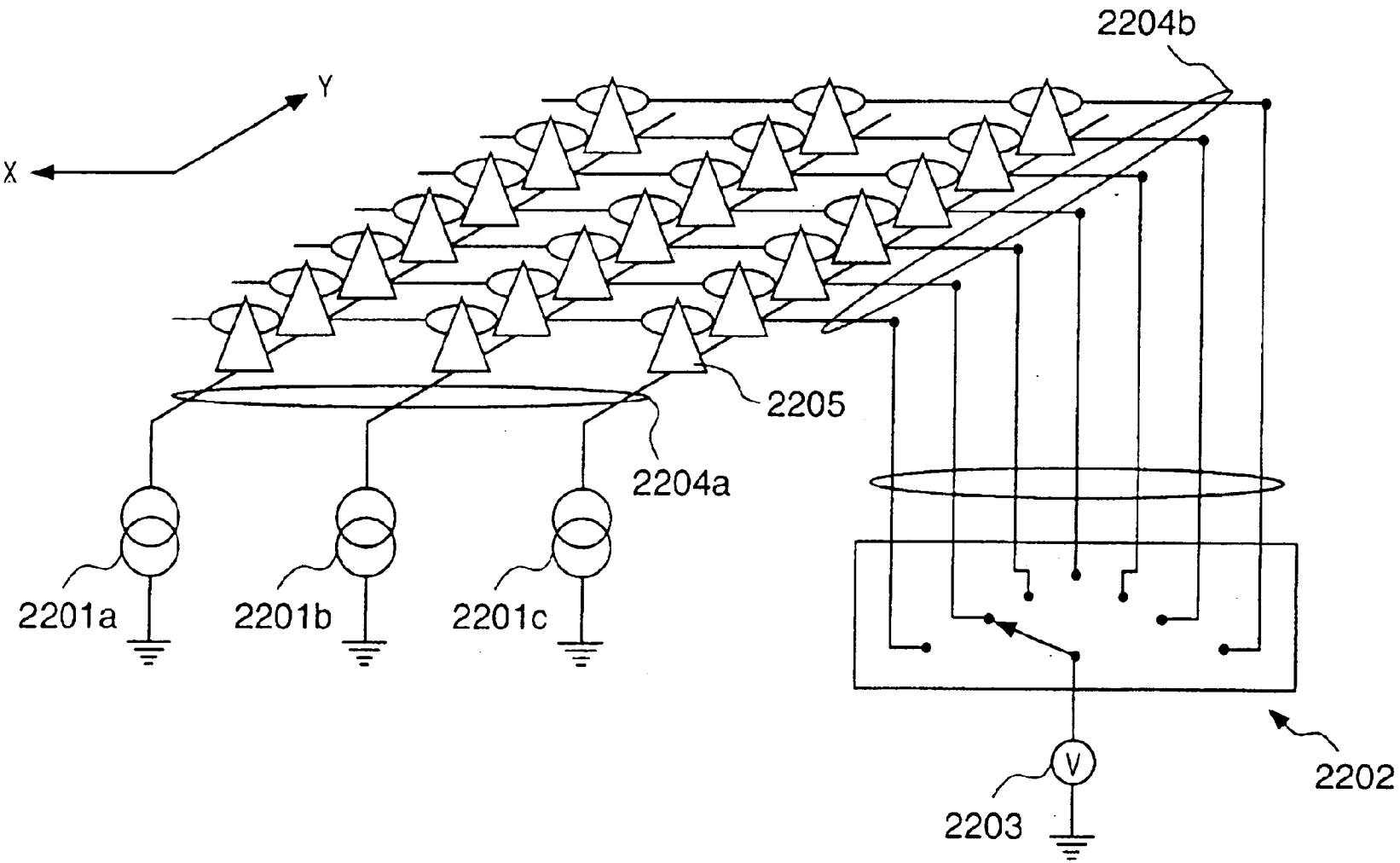
FIG. 2 is a schematic view showing a conventional electron source apparatus using an FE type device.
Figure 3:
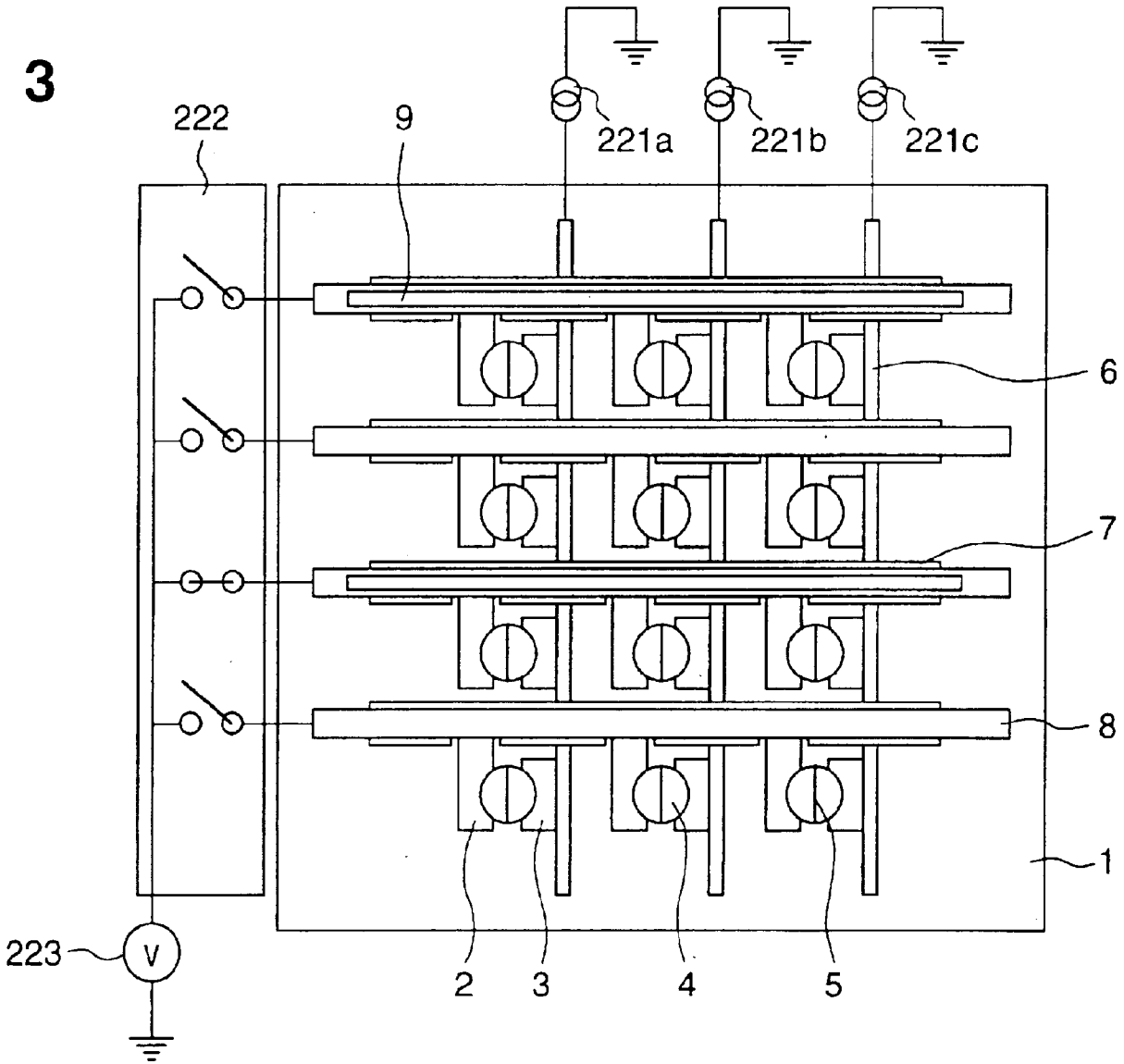
FIG. 3 is a schematic plan view showing an embodiment of an electron source apparatus according to the present invention.
Figure 4:
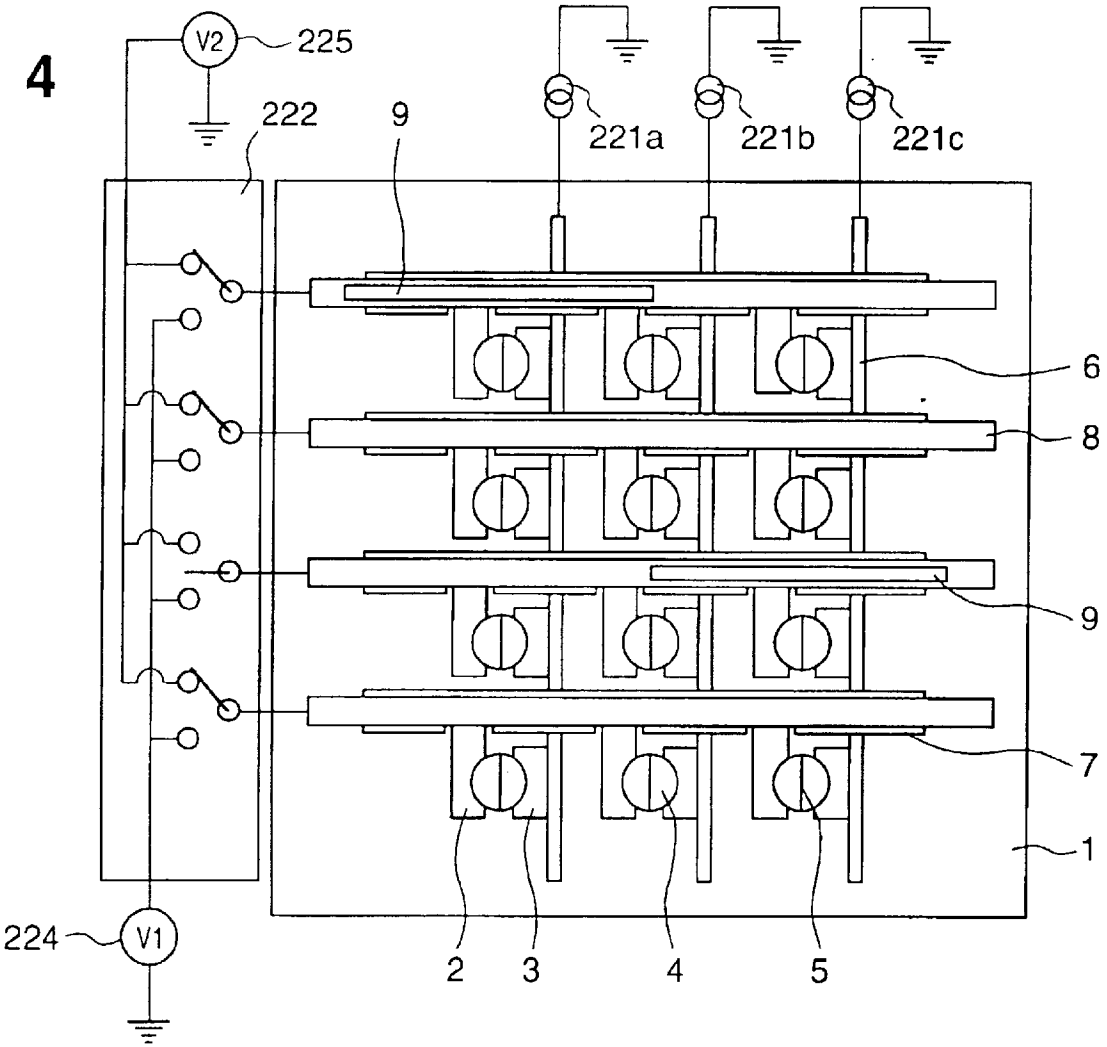
FIG. 4 is a schematic plan view showing another embodiment of an electron source apparatus according to the present invention.

FIGS. 3 and 4 are schematic plan views showing an embodiment of an electron source apparatus according to the present invention. The electron source apparatus of this embodiment uses a surface-conduction emission type electron-emitting device, but the present invention can also be suitably applied to another type of cold cathode electron-emitting device such as an FE type or MIM type device. For descriptive convenience, FIGS. 3 and 4 show an electron source apparatus having 4×3=12 electron-emitting devices. In practice, in the electron source apparatus of this embodiment, 500 devices in the row direction and 1,500 devices in the column direction are arrayed in a matrix.

As shown in FIGS. 3 and 4, each electron-emitting device of the electron source apparatus is connected to a row-direction wiring line 8 and column-direction wiring line 6. Spacers 9 are arranged on some of the row-direction wiring lines 8. In an example shown in FIG. 3, the spacers 9 are arranged at identical positions on the row-direction wiring lines 8 on which the spacers 9 are arranged. As shown in FIG. 4, the spacers 9 may be arranged at different positions on the row-direction wiring lines 8 on which the spacers 9 are arranged. "The spacers 9 are arranged at different positions on the row-direction wiring lines 8" means an arrangement in which the distance from an intersection with the same column-direction wiring line 6 to the spacer 9 on each row-direction wiring line 8 is changed, or the spacers 9 different in size are arranged on the respective row-direction wiring lines 8.

The respective column-direction wiring lines 6 are connected to controlled constant current sources 221*a*, 221*b*, and 221*c* serving as controlled current application means. The controlled constant current source is a current source capable of outputting a desired current value.

The respective row-direction wiring lines 8 are connected to a voltage application means made up of a switching circuit and voltage source. As shown in FIG. 3, the switching circuit and voltage source may be constituted by a voltage source 223 and a switching circuit 222 for selecting the row-direction wiring lines 8 while sequentially scanning them. As shown in FIG. 4, the switching circuit and voltage source may adopt two voltage sources 224 and 225, and apply a predetermined potential to row-direction wiring lines 8 other than a row-direction wiring line 8 selected by the switching circuit 222.

The arrangement shown in FIG. 4 can prevent unselected row-direction wiring lines 8 from floating, can also control a leakage current, and can be used more preferably than the arrangement shown in FIG. 3.

The electron source apparatus of the present invention will be explained in more detail with reference to an embodiment.

This embodiment will exemplify the steps in forming an electron source apparatus using a surface-conduction emission type electron-emitting device, and an image forming apparatus using the electron source apparatus.

The steps in forming an electron source apparatus according to this embodiment will be described with reference to FIGS. 5 to 7. FIG. 5 shows sectional views of the steps in forming the electron source apparatus shown in FIG. 3 and the like. FIGS. 6 and 7 show plan views of the steps in forming the electron source apparatus shown in FIG. 3 and the like. In FIGS. 6 and 7, the electron source apparatus has nine electron-emitting devices for descriptive convenience.

Step 1: An $SiO_2$ layer was formed to a thickness of 0.5 $\mu$m on one major surface of soda-lime glass by sputtering, thereby obtaining a substrate 1.

Figure 5A:
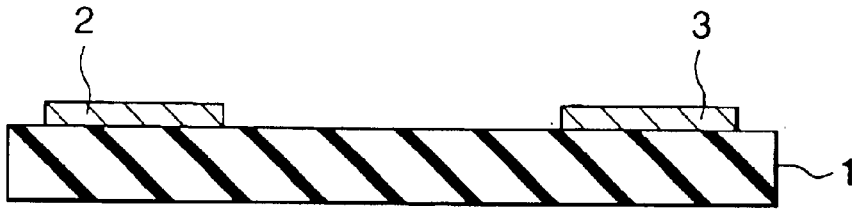
Figure 6A:
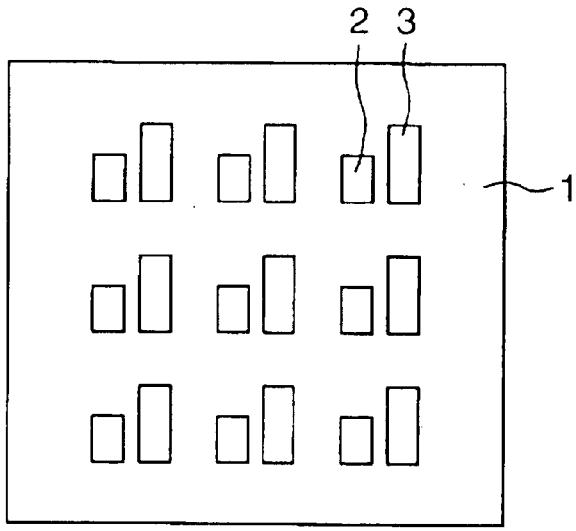

As shown in FIGS. 6*a* and 5*a*, 500×1,500 pairs of device electrodes 2 and 3 were formed. Formation of the device electrodes 2 and 3 used offset printing. More specifically, organic Pt paste containing Pt was applied to an intaglio plate having recesses corresponding to the pattern of the device electrodes 2 and 3, and this paste was transferred to the substrate 1. The transferred ink was heated and calcined to form device electrodes 2 and 3.

Figure 6B:
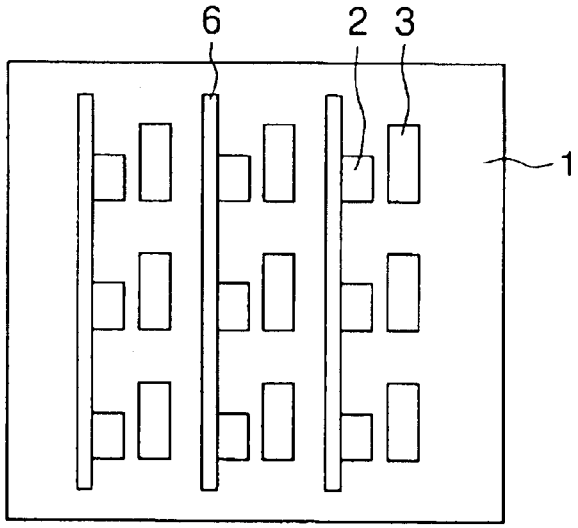

Step 2: As shown in FIG. 6*b*, column-direction wiring lines 6 (also called X-direction wiring lines or lower wiring lines) were formed to be connected to the device electrodes 2 each of which was one of the device electrodes. Formation of the column-direction wiring lines 6 used screen printing. More specifically, Ag paste was printed on the substrate 1 via a screen plate having openings corresponding to the pattern of the column-direction wiring lines 6, and the printed paste was heated and calcined to form Ag column-direction wiring lines 6.

Figure 6C:
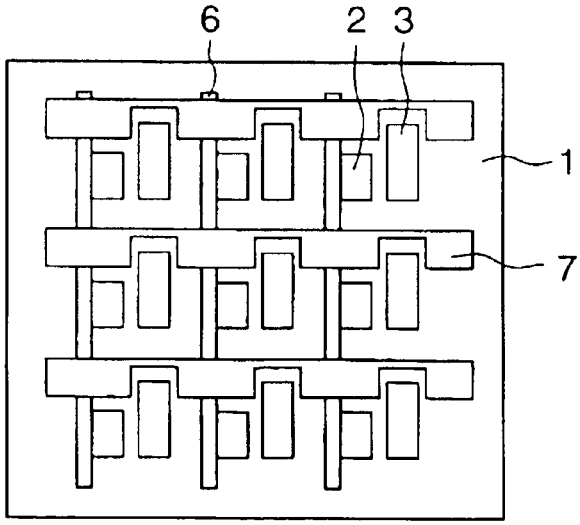

Step 3: As shown in FIG. 6*c*, interlevel insulating layers 7 were formed at intersections between the column-direction wiring lines 6 and row-direction wiring lines 8. Formation of the interlevel insulating layers 7 used screen printing. As shown in FIG. 6*c*, the shape of the interlevel insulating layer 7 was a comb finger shape which covered the intersection between the column-direction wiring line 6 and the row-direction wiring line 8, and had a recess at which the row-direction wiring line 8 and the device electrode 3 could be connected to each other. More specifically, glass paste which mainly contained lead oxide and was prepared by mixing a glass binder and resin was printed on the substrate 1, and the printed paste was heated and calcined to form interlevel insulating layers 7.

Figure 7A:
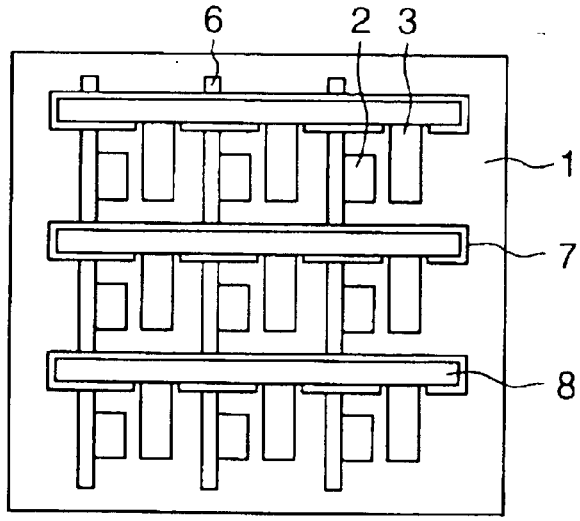

Step 4: As shown in FIG. 7*a*, row-direction wiring lines 8 (also called Y-direction wiring lines or upper wiring lines) were formed to be connected to the device electrodes 3 each of which was one of the device electrodes. Formation of the row-direction wiring lines 8 employed screen printing. More specifically, Ag paste was printed on the substrate 1 via a screen plate having openings corresponding to the pattern of the row-direction wiring lines 8, and the printed paste was heated and calcined to form Ag row-direction wiring lines 8.

Figure 5B:
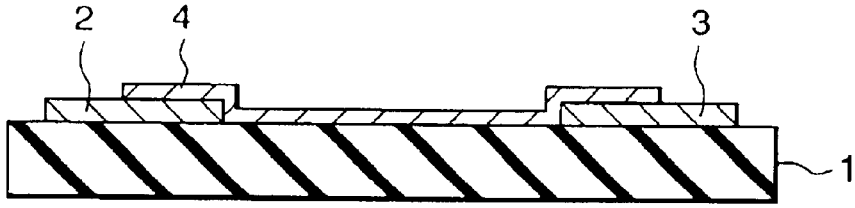
Figure 7B:
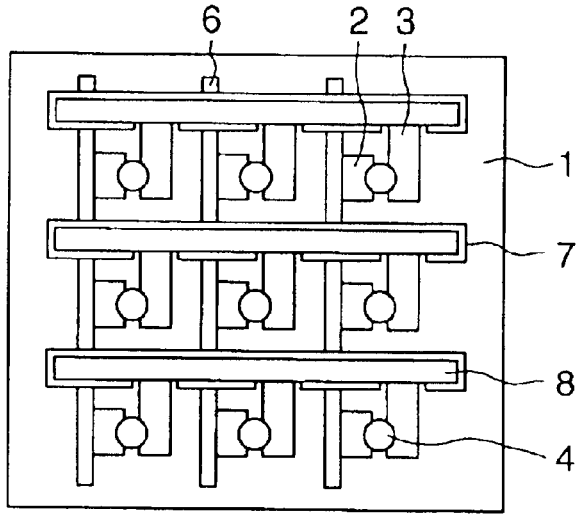
Figure 7C:
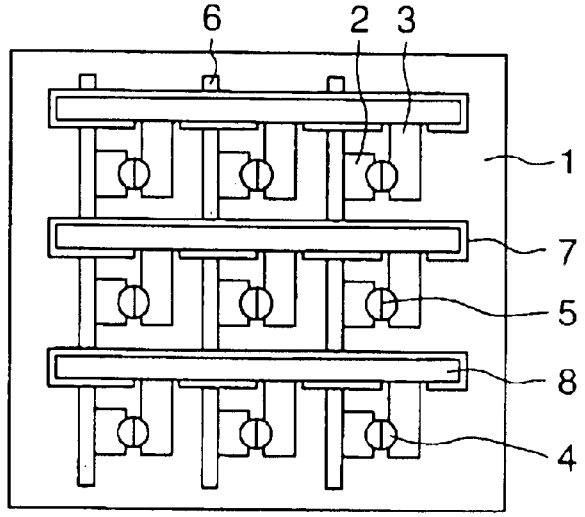

Step 5: As shown in FIGS. 5*b* and 7*b*, conductive films 4 were formed to connect the device electrodes 2 and 3. Formation of the conductive films 4 used a bubble-jet method as one of ink-jet methods. More specifically, droplets of an aqueous solution of 0.15% of a Pd organic metal compound, 15% of isopropyl alcohol, 1% of ethylene glycol, and 0.05% of polyvinyl alcohol were applied between the device electrodes 2 and 3 by the ink-jet method.

Subsequently, the droplets were calcined in the atmosphere at 350° C. to form PdO conductive films 4. The PdO film thickness was about 15 nm. Although this embodiment adopted the ink-jet method, formation of the conductive films 4 can use another method such as sputtering.

Step 6: An unevaporative getter (not shown) was applied on each row-direction wiring line 8 via a mask by a reduced-pressure plasma spraying method. The getter material was a Zr—Fe—V alloy.

By these steps, an electron source substrate before forming processing was formed.

Step 7: The electron source substrate 1 before forming processing was placed in a chamber (not shown), and the interior of the chamber was evacuated to about $10^{-5}$ [Torr].

Figure 5C:
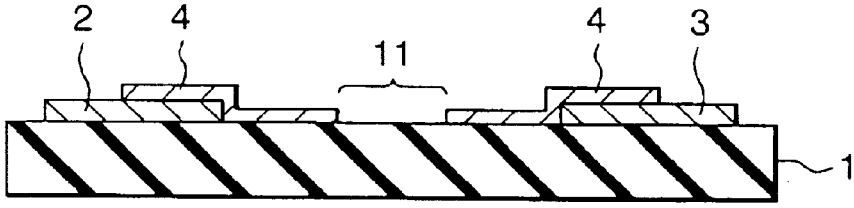
Figure 5D:
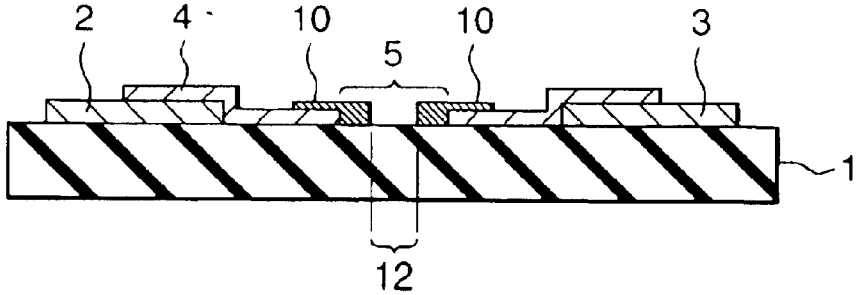

As shown in FIG. 5*c*, electrification forming processing was executed via the column-direction wiring lines 6 and row-direction wiring lines 8 to form gaps 11 in part of the conductive films 4. The maximum voltage applied in the forming step was 5.1 V.

Then, electrification activation processing was done to form carbon films 10 in the gaps 11 formed by forming processing and on the conductive films 4 near the gaps, thereby forming electron-emitting portions 5. In the electrification activation step, an organic gas (benzonitrile) was introduced into the chamber to $10^{-4}$ [Torr], and brought into contact with the gaps 11. In this state, a constant voltage pulse of 15 V was applied to the conductive films 4 via the column-direction wiring lines 6 and row-direction wiring lines 8.

Step 8: While the chamber and electron source substrate 1 were heated, the interior of the chamber was evacuated until the internal pressure of the chamber reached $10^{-10}$ [Torr].

By these steps, the electron source substrate 1 was formed.

Spacers 9 were arranged on the electron source substrate. A counter substrate on which Al was deposited as an accelerating electrode for accelerating electrons from the fluorescent substances and electron source was integrated with the electron source substrate to complete an image forming apparatus.

In this embodiment, the spacer was constituted such that electrodes were formed at the ends of a glass substrate (end in contact with the wiring side on the electron source substrate and end in contact with the accelerating electrode of the counter substrate), and a conductive film was formed on the entire surface of the glass substrate to suppress charge-up of the spacer.

Figure 16B:
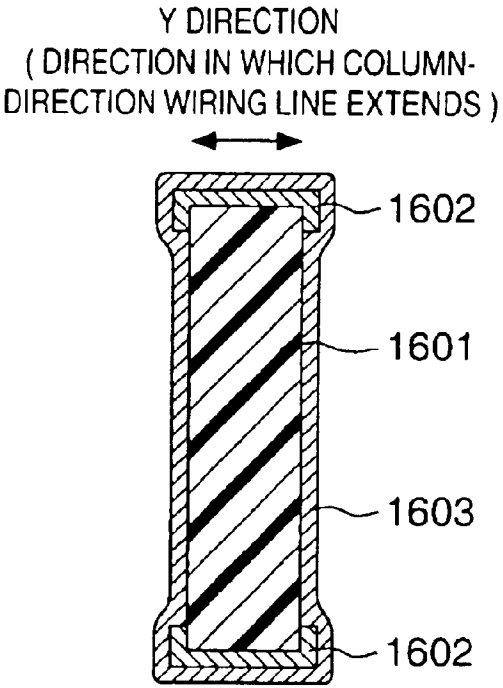
FIG. 16 shows views of the structure of a spacer used in the embodiment of the present invention.
Figure 16A:
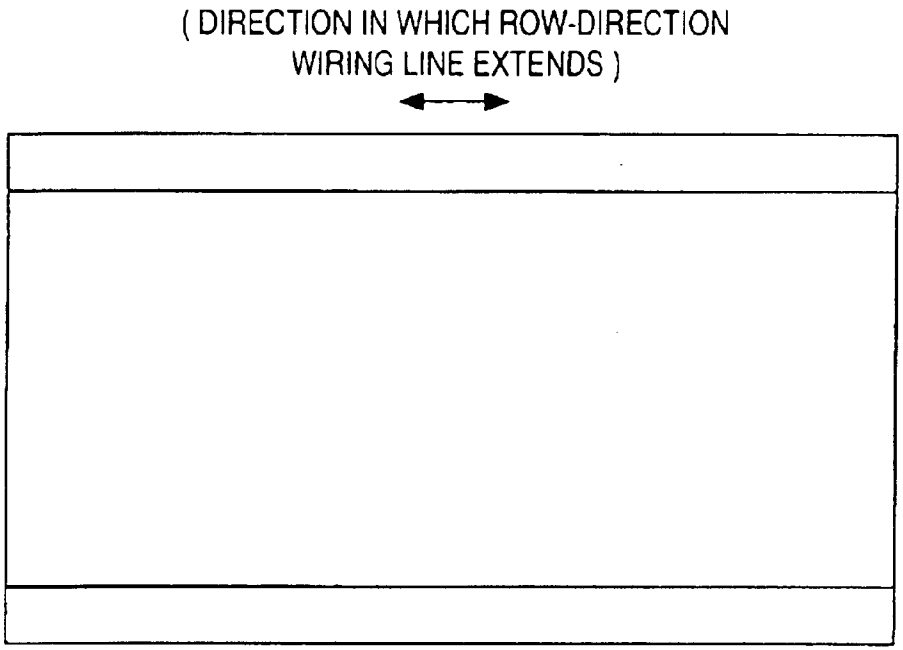

FIGS. 16*a* and 16*b* show the structure of the spacer used in this embodiment. FIG. 16*a* is a view showing the spacer used in the embodiment when viewed from the longitudinal direction of the column-direction wiring line, and FIG. 16*b* is a view showing the spacer used in the embodiment when viewed from the longitudinal direction of the row-direction wiring line. Reference numeral 1601 denotes glass serving as a spacer substrate. End electrodes 1602 were formed at the ends of the spacer substrate 1601. The end electrodes 1602 were made of Al. A conductive film 1603 was formed on the surfaces of the spacer substrate 1601 and end electrodes 1602. The conductive film 1603 was made of a nitride film of W and Ge.

Figure 8:
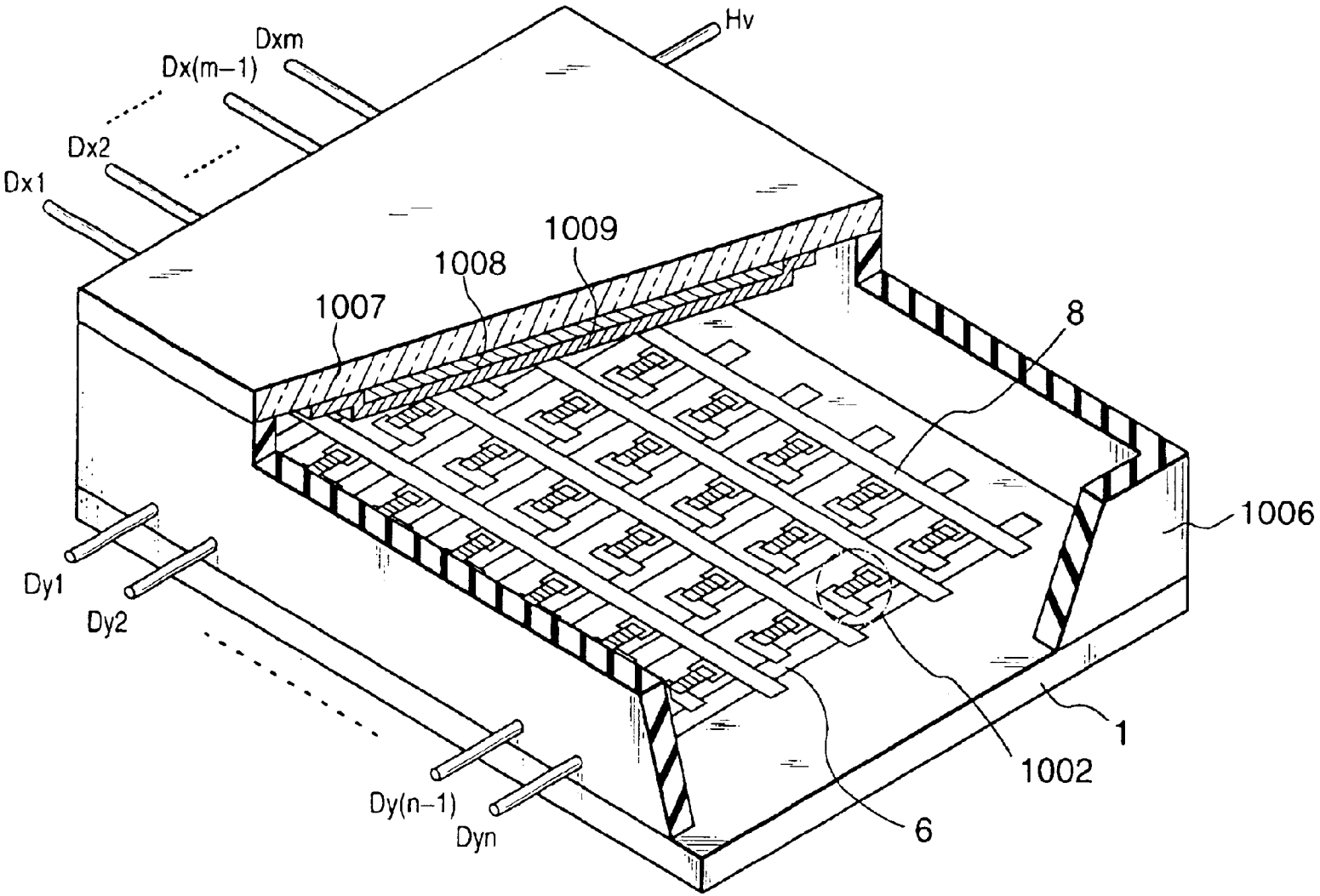
FIG. 8 is a perspective view showing an embodiment of a display panel (image forming apparatus) according to the present invention.

FIG. 8 is a partially cutaway perspective view of the display panel (image forming apparatus) used in this embodiment showing the internal structure of the display panel.

In FIG. 8, reference numeral 1 denotes the electron source substrate (rear plate); 1006, a side wall; and 1007, a face plate. The electron source substrate 1, side wall 1006, and face plate 1007 serving as a counter substrate constitute an airtight container for keeping the interior of the display panel vacuum. To construct the airtight container, the electron source substrate 1, side wall 1006, and face plate 1007 must be sealed to obtain sufficient strength and maintain airtight condition at the joint portions of the respective members. For example, frit glass was applied to the joint portions, and calcined in the atmosphere or nitrogen atmosphere to seal the members. A method of evacuating the interior of the airtight container will be described later. FIG. 8 shows a structure except for spacers in order to simplify the internal structure of the display panel.

Figure 9:
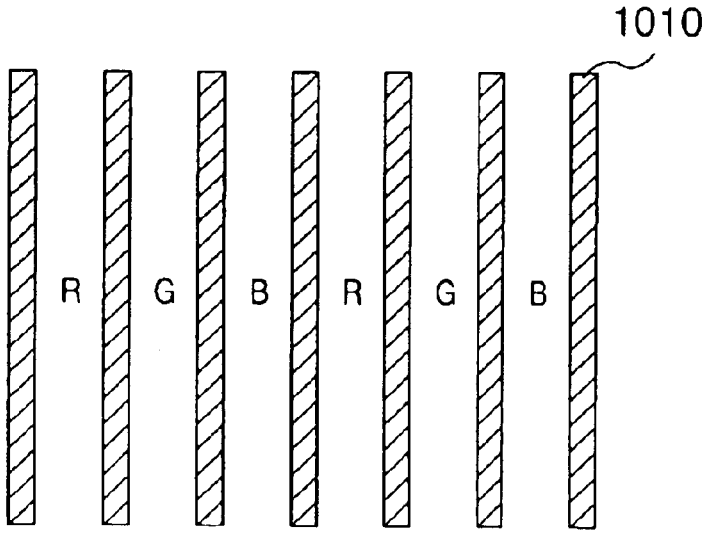
FIG. 9 is a view showing the coating pattern of fluorescent substances in the fluorescent film of the display panel (image forming apparatus) shown in FIG. 8.

The face plate 1007 has a fluorescent film 1008 on its lower surface. Since this embodiment relates to a color display apparatus, the fluorescent film 1008 is coated with fluorescent substances of red (R), green (G), and blue (B), i.e., three primary colors used in the CRT field. As shown in FIG. 9, fluorescent substances of the respective colors are formed into stripes, and black members 1010 are formed between the stripes of the fluorescent substances. The purposes of forming the black members 1010 are to prevent display color misregistration even if the irradiation position of an electron beam is shifted to some extent, and to prevent degradation of display contrast by shutting off reflection of external light. The black members 1010 are formed from graphite as a main component, but may be formed from another material so long as the above purpose is attained.

Figure 10:
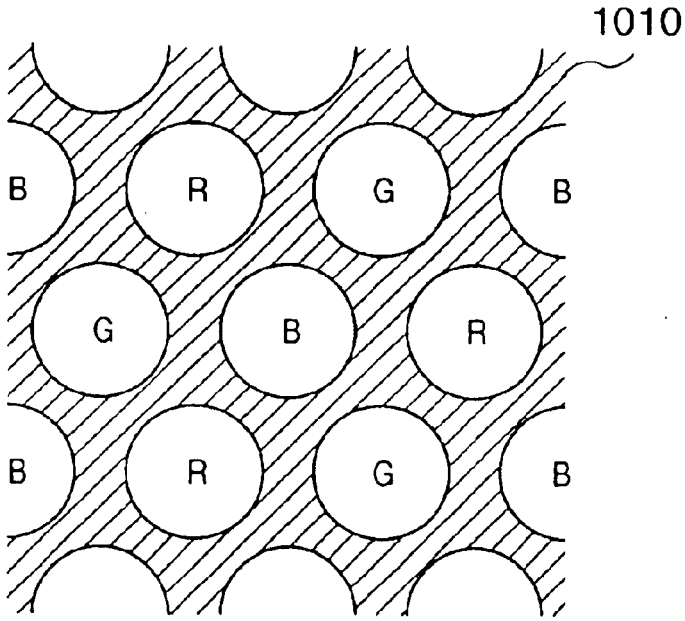
FIG. 10 is a view showing another coating pattern of fluorescent substances in the fluorescent film of the display panel (image forming apparatus) shown in FIG. 8.

The coating pattern of the fluorescent substances of the three primary colors is not limited to stripes shown in FIG. 9, but may be a delta pattern as shown in FIG. 10 or another pattern.

Note that when a monochrome display panel is to be formed, fluorescent substances of a single color may be used as the fluorescent substances 1008, and the black member need not always be used.

A metal back 1009, which is well-known in the CRT field, is formed on the fluorescent film 1008 on the rear plate side. The purposes of forming the metal back 1009 are to improve the light utilization ratio by mirror-reflecting part of the light emitted by the fluorescent film 1008, to protect the fluorescent film 1008 from collision with negative ions, to use the metal back 1009 as an electrode for applying an electron beam accelerating voltage of, e.g., 10 kV, to use the metal back 1009 as a conductive path of electrons which excited the fluorescent film 1008, and the like. The metal back 1009 was formed by forming the fluorescent film 1008 on the face plate substrate 1007, smoothing the surface of the fluorescent film, and depositing aluminum on the smoothed surface by vacuum deposition.

To apply an accelerating voltage or improve the conductivity of the fluorescent film, e.g., ITO transparent electrodes may be formed between the face plate substrate 1007 and the fluorescent film 1008 though these electrodes were not used in this embodiment.

Reference symbols Dx1 to Dxm and Dy1 to Dyn denote feeding terminals of an airtight structure in order to electrically connect the display panel to an electric circuit. Dx1 to Dxm are electrically connected to the row-direction wiring lines 8 of the electron source; Dy1 to Dyn, to the column-direction wiring lines 6 of the electron source; and Hv, to the metal back 1009 of the face plate.

To evacuate the interior of the airtight container, an exhaust pipe and vacuum pump (neither is shown) were connected after the airtight container was assembled, and the airtight container was evacuated to a vacuum of about $10^{-7}$ [Torr]. While the airtight container was kept evacuated, the airtight container was heated to a temperature at which activation of the getter progresses. This state was held until the activated state of the getter became a desired state. In this manner, the unevaporative getter formed in step 5 was activated.

The electron source, image display apparatus, and driving method therefor in this embodiment will be explained in detail.

Figure 11:
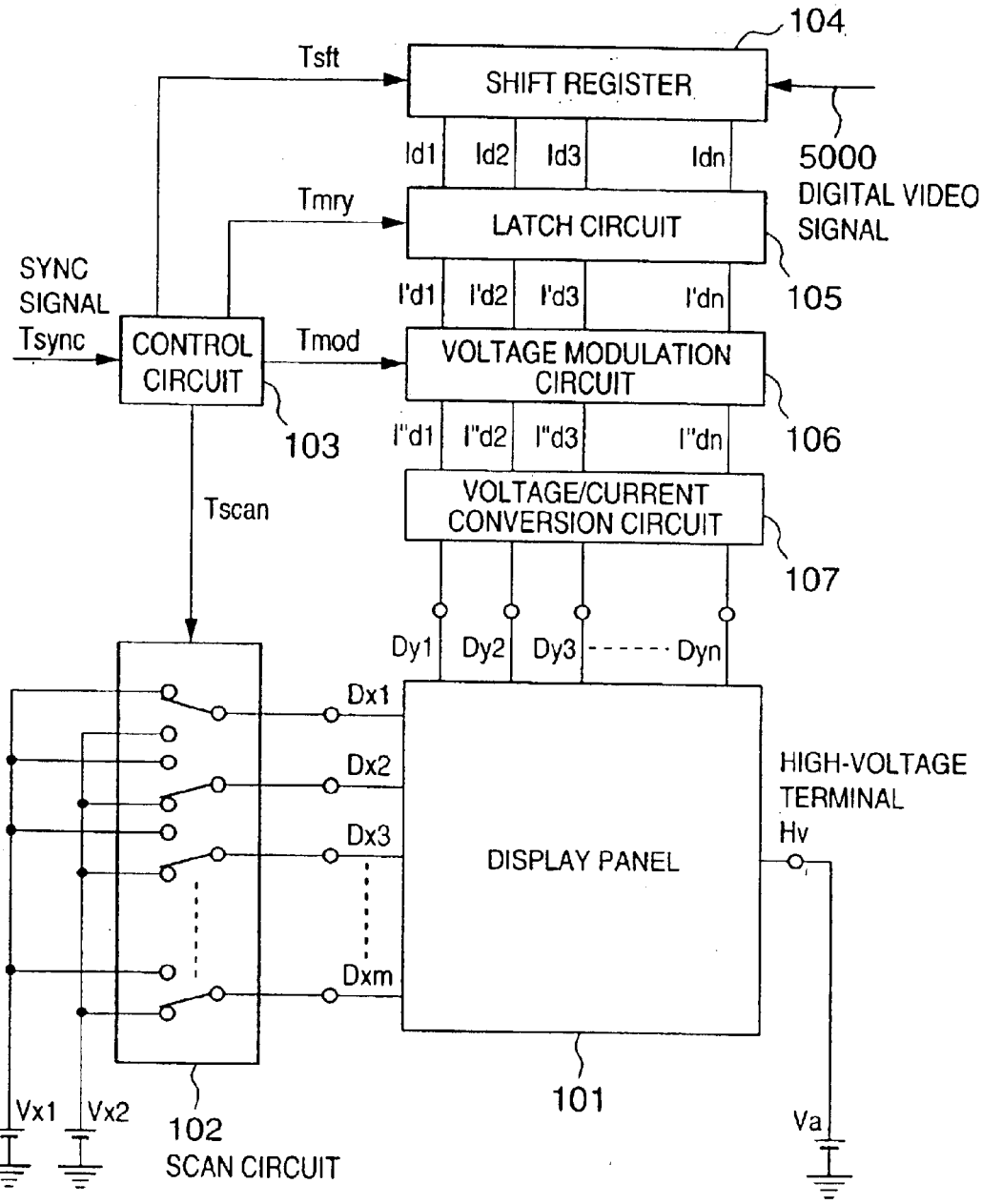
FIG. 11 is a block diagram showing the driving circuit of the display panel (image forming apparatus) shown in FIG. 8.

The image forming apparatus (display panel 101) formed in the above-described steps was connected to a circuit shown in FIG. 11.

In FIG. 11, the display panel 101 is connected to an external circuit via the terminals Dx1 to Dxm (m=500) and the terminals Dy1 to Dyn (n=1,500). The high-voltage terminal Hv on the face plate is connected to an external high-voltage power supply Va to accelerate emitted electrons. The terminals Dx1 to Dxm receive scan signals for sequentially driving the multi electron beam source formed in the above-described panel, i.e., the surface-conduction emission type electron-emitting devices wired in a matrix of 500 rows and 1,500 columns in units of rows. The terminals Dy1 to Dyn receive modulation signals for controlling electron beams output from the respective surface-conduction emission type electron-emitting devices on one row selected by the scan signal.

A scan circuit 102 will be explained. This circuit incorporates 500 switching elements. On the basis of a control signal Tscan generated by a control circuit 103, each switching element connects a DC power supply Vx1 to the wring terminal of a scanned electron-emitting device row, and a DC power supply Vx2 to the terminal of an unscanned electron-emitting device row. Each switching element can be easily formed from a switching element such as an FET. The output voltages of Vx1 and Vx2 will be described later.

The control circuit 103 matches the operation timings of respective circuits so as to attain proper display based on an externally input image signal. The externally input image signal includes a composite signal of image data and a sync signal, like an NTSC signal, or image data and a sync signal which are separated in advance. In this embodiment, the latter signal will be described. (Note that the former image signal can also be processed as follows by adopting a well-known sync separation circuit and separating image data and a sync signal from each other.

More specifically, the control circuit 103 generates control signals Tscan and Tmry on the basis of the externally input sync signal Tsync. In general, the sync signal includes a vertical sync signal and horizontal sync signal. In this case, however, the sync signal is represented by Tsync for descriptive convenience.

Externally input image signal (luminance data) is input to a shift register 104. The shift register 104 serial/parallel-converts in units of lines of an image the image data serially input in time-series. The shift register 104 operates on the basis of the control signal (shift signal) Tsft input from the control circuit 103. Data of one line of another parallel-converted image (corresponding to driving data of N electron-emitting devices) are output as parallel signals Id1 to Idn to a latch circuit 105.

The latch circuit 105 is a memory circuit for storing data of one line of an image for a necessary time, and simultaneously stores Id1 to Idn in accordance with a control signal Tmry sent from the control circuit 103. The stored data are output as I'd1 to I'dn to a voltage modulation circuit 106.

The voltage modulation circuit 106 outputs, as I"d1 to I"dn, voltage signals whose amplitudes are modulated in accordance with the image data I'd1 to I'dn. More specifically, the voltage modulation circuit 106 outputs a voltage pulse having a larger amplitude for a higher luminance level of image data. For example, the voltage modulation circuit 106 outputs a voltage of 2 [V] for the maximum luminance, and a voltage of 0 [V] for the minimum luminance. The output signals I"d1 to I"dn are input to a voltage/current conversion circuit 107.

The voltage/current conversion circuit 107 is a circuit (controlled current application means) for controlling a current to be flowed through a surface-conduction emission type electron-emitting device in accordance with the amplitude of an input voltage signal. An output signal from the circuit 107 is applied to the terminals Dy1 to Dyn of the display panel 101.

Figure 12:
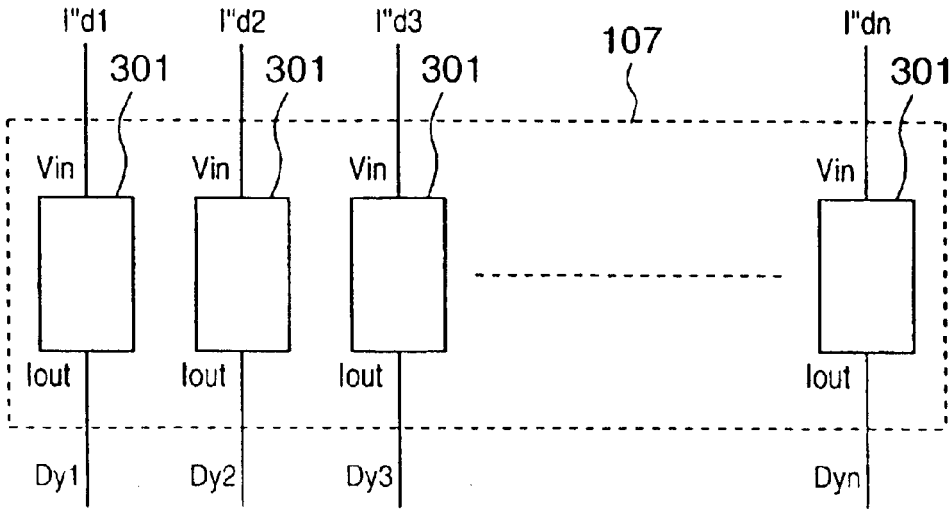
FIG. 12 is a view showing the internal arrangement of a voltage/current conversion circuit shown in FIG. 11.

FIG. 12 is a view showing the internal arrangement of the voltage/current conversion circuit 107 shown in FIG. 11. As shown in FIG. 12, the voltage/current conversion circuit 107 incorporates voltage/current converters 301 in correspondence with the input signals I"d1 to I"dn.

Figure 13:
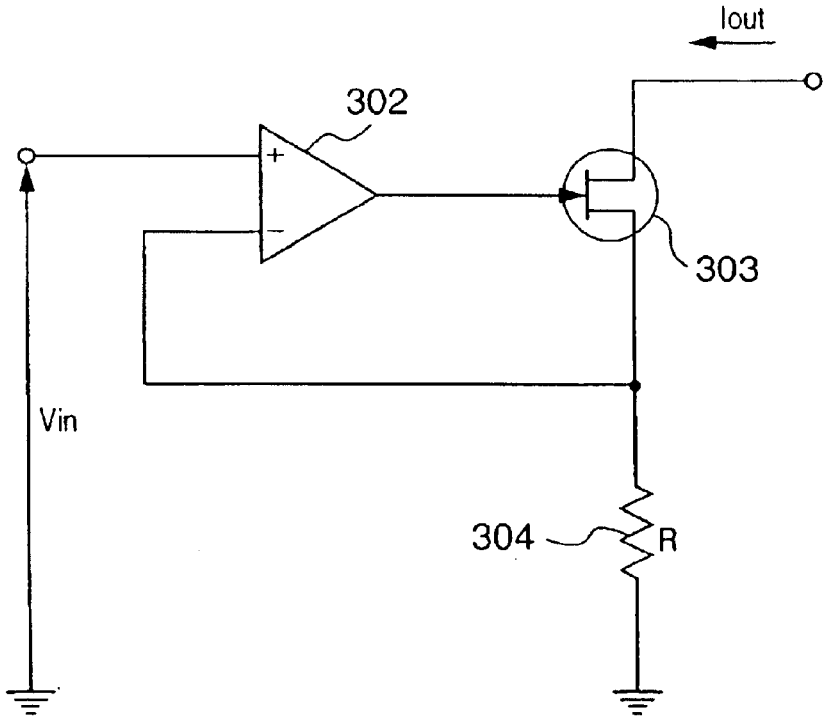
FIG. 13 is a circuit diagram showing a voltage/current converter shown in FIG. 12.

Each voltage/current converter 301 is constituted by a circuit as shown in FIG. 13. In FIG. 13, reference numeral 302 denotes an operational amplifier; 303, e.g., a junction FET type transistor; and 304, a resistor of R [Ω]. The circuit in FIG. 13 determines the magnitude of a current Iout to be output in accordance with the amplitude of an input voltage signal Vin. This current Iout satisfies $$Iout=Vin/R \tag{1}$$

By setting the design parameter of the voltage/current converter 301 to a proper value, the current Iout to be flowed through a surface-conduction emission type electron-emitting device can be controlled in accordance with the voltage-modulated image data Vin.

In this embodiment, a resistance R of the resistor 304 and another design parameter are determined as follows.

Figure 14:
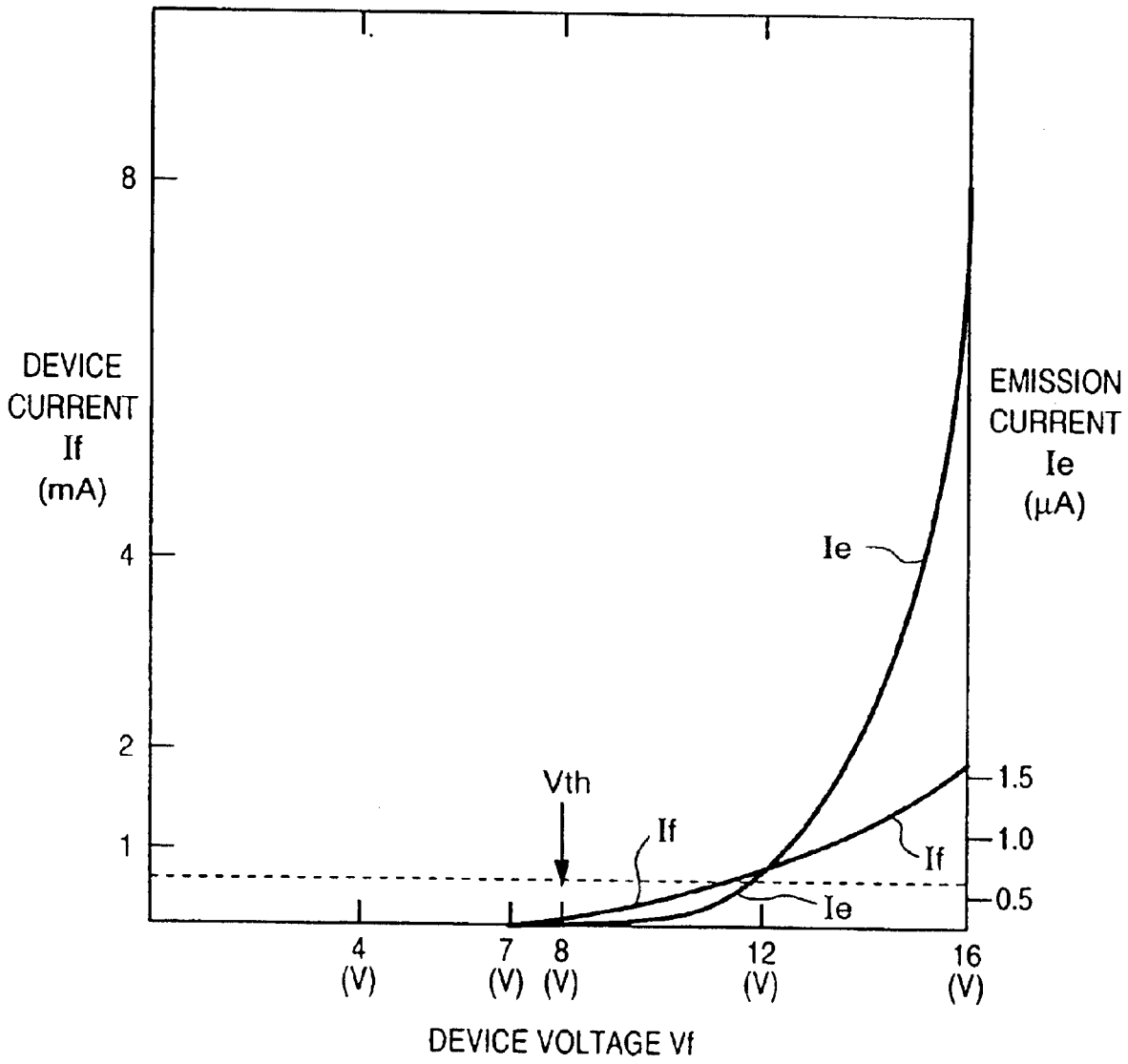
FIG. 14 is a graph showing the electron emission characteristic of an electron-emitting device in the display panel (image forming apparatus) shown in FIG. 8.

That is, the surface-conduction emission type electron-emitting device used in this embodiment has an electron emission characteristic having Vth=8 [V] as a threshold voltage, as shown in FIG. 14. To prevent unwanted emission of the display screen, a voltage applied to an unscanned electron-emitting device row must necessarily be lower than 8 [V]. Since the scan circuit 102 in FIG. 11 applies the output voltage of the voltage source Vx2 to the row-direction wiring line of an unscanned electron-emitting device row, the voltage source Vx2 must satisfy $$Vx2<8 \tag{2}$$

For this purpose, this embodiment defined the voltage of Vx2 to 7.5 [V]. Hence, the voltage applied to an unscanned electron-emitting device does not exceed 7.5 [V] at maximum.

Figure 15:
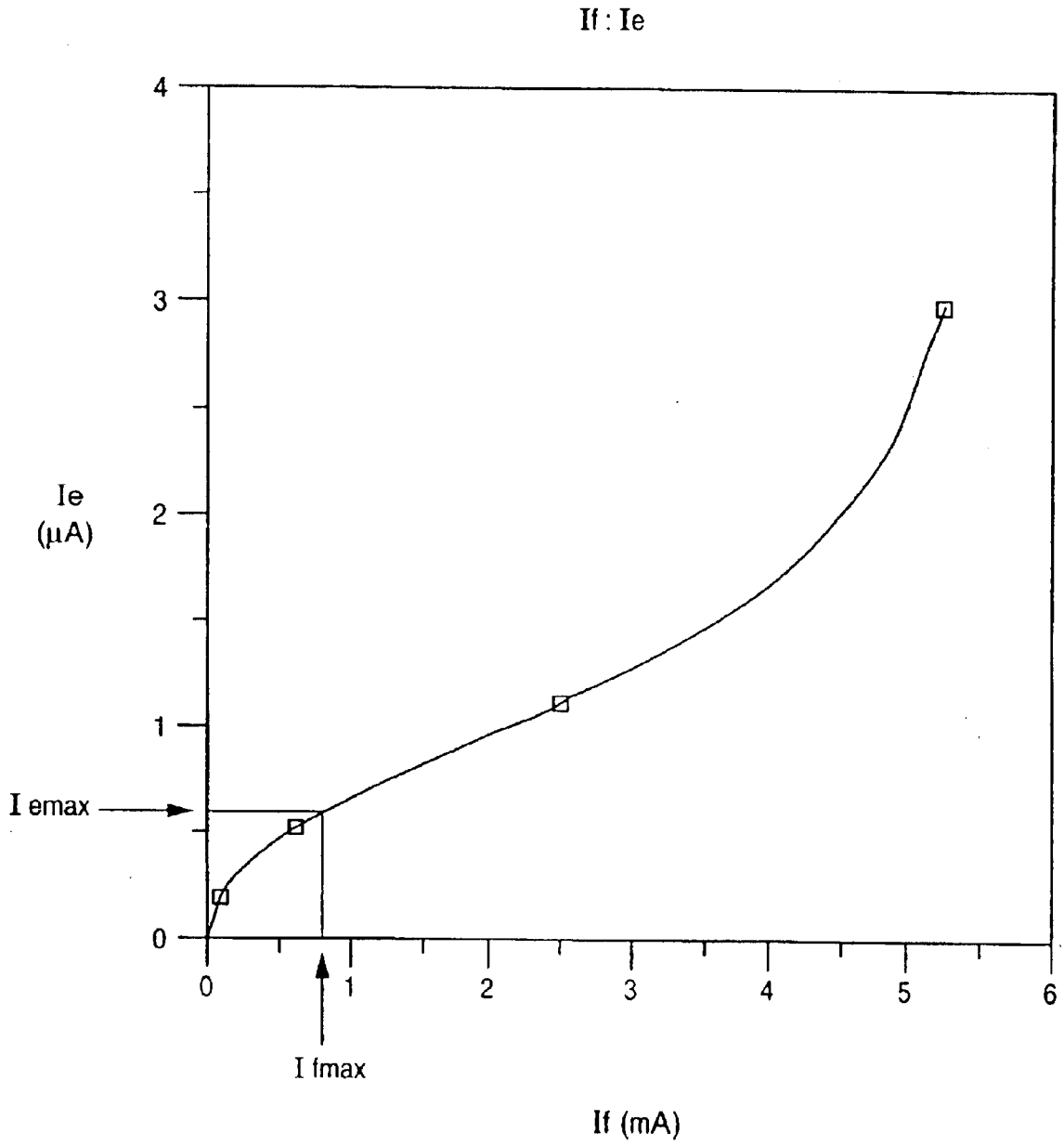
FIG. 15 is a graph showing the correlation between an emission current Ie and device current If of the electron-emitting device in the display panel (image forming apparatus) shown in FIG. 8.

An electron-emitting device during scanning must appropriately emit an electron beam in accordance with image data. In this embodiment, an emission current Ie was controlled by properly modulating a device current If using the If-Ie characteristic of the surface-conduction emission type electron-emitting device shown in FIG. 15. As shown in FIG. 15, an emission current in causing the display apparatus to emit light at the maximum luminance was set to Iemax, and the device current at this time was set to Ifmax. For example, Iemax=0.6 [μA], and Ifmax=0.8 [mA].

The voltage Vin of an output signal from the voltage modulation circuit 106 is 2 [V] for the maximum luminance and 0 [V] for the minimum luminance, and is substituted into equation (1) to determine the resistance R to $$R=2/0.0008=2.5\ [k\Omega].$$

In emitting light at the maximum luminance, the surface-conduction emission type electron-emitting device has an electrical resistance:

$$12[V]/0.8[mA]=15[k\Omega]$$

Considering that this surface-conduction emission type electron-emitting device was series-connected to the resistance R (=2.5 [kΩ]) the output voltage of the voltage source Vx1 was set to $$Vx1=15[V]$$

An accelerating voltage Va applied to fluorescent substances was determined as follows. That is, application power to fluorescent substances necessary for obtaining a desired maximum luminance was calculated from the emission efficiency of fluorescent substances, and the magnitude of the accelerating voltage Va was determined to 10 [kV] so as to set (Iemax×Va) to satisfy the application power.

In this way, the parameters were set.

As described above, this embodiment used the relationship between the device current If and emission current Ie of the surface-conduction emission type electron-emitting device shown in FIG. 15. The device current If was modulated in accordance with image data to control the emission current Ie and attain gray-level display.

When no controlled constant current source was used, the current If applied to the surface-conduction emission type electron-emitting device varied, and luminance faithful to image data was not reproduced. When a controlled constant current source was used, like this embodiment, the luminance did not vary, and no color misregistration occurred.

Since Vx2 was applied to an unselected row, and the voltage/current conversion circuit 107 modulated the device current If flowing through the surface-conduction emission type electron-emitting device, the leakage current could be kept constant, and an image could be displayed on the entire display screen at a luminance faithful to an original image signal.

This embodiment has described an arrangement shown in FIG. 12 as an embodiment of the voltage/current conversion circuit 107. However, the circuit arrangement is not limited to this as far as the voltage/current conversion circuit 107 can modulate a current flowing through a load resistor (surface-conduction emission type electron-emitting device) in accordance with an input voltage. For example, when a relative large output current Iout is required, a power transistor is desirably Darlington-connected to the transistor 303.

This embodiment employs peak value modulation of modulating the magnitude of If in accordance with an image signal. In practicing the present invention, the method is not limited to this, and pulse width modulation can also be employed. In this case, it is suitable to modulate the application time while keeping If constant.

This embodiment uses as an input video signal a digital video signal which can easily undergo data processing. However, this is not limited to a digital video signal, and may be an analog video signal.

This embodiment adopts for serial/parallel conversion processing the shift register 104 which can easily process a digital signal. However, the present invention is not limited to this, and may use a random access memory having a function equivalent to the shift register by controlling a storage address and sequentially changing the storage address.

As described above, this embodiment could suppress variations in voltage effectively applied to a device. Accordingly, a high-quality image almost free from a luminance distribution could be formed.

As has been described above, the present invention comprises a means for sequentially turning on a plurality of row-direction wiring lines, and a controlled current application means for applying a predetermined controlled current to a plurality of column-direction wiring lines. Since the current application means suppresses generation of variations in current applied to electron-emitting devices, this can suppress generation of variations in electron emission state from the electron-emitting devices.

INDUSTRIAL APPLICABILITY

The invention of the present application can be used in the field of electron source apparatuses, and more particularly in the field of image forming apparatuses.

What is claimed is:

1. An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and a spacer for maintaining an interval between the electron source and the counter substrate is arranged on some of the row-direction wiring lines among the plurality of row-direction wiring lines, comprising:

a circuit for sequentially turning on the plurality of row-direction wiring lines; and a controlled current application circuit for applying a predetermined controlled current to the plurality of column-direction wiring lines.

2. An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and spacers for maintaining an interval between the electron source and the counter substrate are arranged at different positions on the plurality of row-direction wiring lines, comprising:

a circuit for sequentially turning on the plurality of row-direction wiring lines; and a controlled current application circuit for applying a predetermined controlled current to the plurality of column-direction wiring lines.

3. An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and a spacer for maintaining an interval between the electron source and the counter substrate is electrically connected to some of the row-direction wiring lines among the plurality of row-direction wiring lines, comprising:

a circuit for sequentially turning on the plurality of row-direction wiring lines; and a controlled current application circuit for applying a predetermined controlled current to the plurality of column-direction wiring lines.

4. An electron source apparatus which has an electron source and a counter substrate arranged to face the electron source and in which the electron source has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, and spacers for maintaining an interval between the electron source and the counter substrate are electrically connected to the row-direction wiring lines at different positions on the plurality of row-direction wiring lines, comprising:

a circuit for sequentially turning on the plurality of row-direction wiring lines; and a controlled current application circuit for applying a predetermined controlled current to the plurality of column-direction wiring lines.

5. The electron source apparatus according to any one of claims 1 to 4, wherein a section of the spacer cut along a plane parallel to a plane in which the counter substrate spreads has a longitudinal direction in a direction in which the row-direction wiring line extends.

6. The electron source apparatus according to any one of claims 1 to 4, wherein one of the spacers is electrically connected to only one of the row-direction wiring lines.

7. The electron.source apparatus according to any one of claims 1 to 4, wherein the spacer comprises a spacer substrate and a portion formed from a material having a resistivity lower than the spacer substrate.

8. An image forming apparatus comprising the electron source apparatus defined in any one of claims 1 to 4, and an image forming member for forming an image by irradiation of electrons from the electron source apparatus.

9. An image forming apparatus comprising the electron source apparatus defined in claim 5, and an image forming member for forming an image by irradiation of electrons from the electron source apparatus.

10. An apparatus comprising:

a plurality of row-direction wiring lines;

a plurality of column-direction wiring lines;

a plurality of devices, wherein each one of said plurality of devices is connected to at least one of said plurality of row-direction wiring lines and at least one of said plurality of column-direction wiring lines;

at least one conductive member, wherein each said conductive member is in contact with a corresponding row-direction wiring line among said plurality of row-direction wiring lines, and wherein said plurality of row-direction wiring lines includes at least one row-direction wiring line with which said at least one conductive member is not in contact and at least one row-direction wiring line with which said at least one conductive member is in contact; and a controlled current application circuit, for applying a predetermined controlled current to said plurality of column-direction wiring lines.

11. The apparatus according to claim 10, wherein one conductive member is connected to only one row-direction wiring line.

12. The apparatus according to claim 10, wherein said conductive member is arranged to influence a resistance value of an electrical path extending from said controlled current application circuit.

13. The apparatus according to claim 10, further comprising a circuit for sequentially turning on said plurality of row-direction wiring lines.

* * * * *

UNITED STATES PATENT AND TRADEMARK OFFICE

CERTIFICATE OF CORRECTION

PATENT NO. : 6,847,338 B2
DATED : January 25, 2005
INVENTOR(S) : Naoto Abe et al.

It is certified that error appears in the above-identified patent and that said Letters Patent is hereby corrected as shown below:

Title page,
Item [56], References Cited, OTHER PUBLICATIONS, "M. Hartwell," reference, "M. Hartwell, IEEE Transactions Electron Devices Conference, 519 (1975); Strong Electron Emission from Patterned Thin-Indium Oxide Thin Films." should read
-- M. Hartwell, IEEE Transactions Electron Devices Conference, 519 (1975);
Strong Electron Emission from Patterned Tin-Indium Oxide Thin Films. --
FOREIGN PATENT DOCUMENTS
"JP 61-31332 2/1989" should read -- JP 64-31332 2/1989 --.

Column 1,
Line 26, ""Radio" should read -- Radio --.
Line 43, "remission" should read -- emission --.
Line 44, "molybdenium" should read -- molybdenum --.

Column 11,
Line 32, "wring," should read -- wiring --.
Line 47, "other." should read -- other). --.

Column 15,
Line 36, "electron.source" should read -- electron source --.

Signed and Sealed this

Twenty-eighth Day of June, 2005

JON W. DUDAS
*Director of the United States Patent and Trademark Office*